US007896157B1

(12) United States Patent
Weaver

(10) Patent No.: US 7,896,157 B1
(45) Date of Patent: Mar. 1, 2011

(54) TOOL LAYOUT CADDY

(76) Inventor: Kenneth M. Weaver, Williamstown, NJ (US)

( * ) Notice: Subject to any disclaimer, the term of this patent is extended or adjusted under 35 U.S.C. 154(b) by 0 days.

(21) Appl. No.: 12/658,239

(22) Filed: Feb. 4, 2010

(51) Int. Cl.
*B65D 85/28* (2006.01)

(52) U.S. Cl. ..... 206/373; 206/223; 206/224; 206/374

(58) Field of Classification Search ..... 206/373, 206/374, 377, 372, 224, 223, 575
See application file for complete search history.

(56) References Cited

U.S. PATENT DOCUMENTS 4,826,007 A * 5/1989 Skeie ..... 206/373
4,901,846 A * 2/1990 Lehman ..... 206/1.8
5,350,065 A * 9/1994 Darrey ..... 206/373
5,833,095 A * 11/1998 Russell et al. ..... 224/576
5,836,446 A * 11/1998 Varnom ..... 206/373
5,848,701 A * 12/1998 Riccabona ..... 206/702
6,059,109 A * 5/2000 Stein ..... 206/373
6,105,768 A * 8/2000 Brown ..... 206/373
6,360,891 B1 * 3/2002 Rideout ..... 206/373
7,159,735 B2 * 1/2007 Morse ..... 220/529
7,197,832 B2 * 4/2007 Bond ..... 33/414
2008/0105779 A1 * 5/2008 Han ..... 242/386

* cited by examiner

*Primary Examiner*—Mickey Yu
*Assistant Examiner*—Rafael Ortiz
(74) *Attorney, Agent, or Firm*—Stuart M. Goldstein

(57) ABSTRACT

A tool layout caddy has an upstanding vertical post with a handle at one end and a base member at the other end. A receptacle for the placement and storage of tools, chalk, and other necessary items for the layout operation is secured to the vertical post. A sheath member is provided for the placement and storage of a measuring square. The base member of the caddy houses the chalk line, a chalk line reservoir for replenishing the chalk line, and a chalk line retracting mechanism. A stop marker ensures that the end section of the chalk line always remains external to the base member and, during use, a hook at the end of the chalk line may be secured to the receptacle for ease of access during layout operations.

8 Claims, 2 Drawing Sheets

TOOL LAYOUT CADDY

BACKGROUND OF THE INVENTION

It is necessary to establish accurate layout lines on the ground surfaces of construction sites to ensure that excavations, buildings, and other structures are properly located on real property. This is routinely accomplished by the use of a chalk line extending from a chalk line receptacle. Each end of the commonly used chalk line is normally held by a worker. The line is then snapped to mark the layout line on the ground's surface. The fact that layout operations usually require two workers represents an inefficient use of manpower time in that more than two individuals must always be available for the work. This is also economically wasteful, as the employer is paying for the time of two workers, in a situation where resources would be saved if only one was required to do the job.

Layout operations are also susceptible to inefficiency when necessary tools are not at the layout site, are misplaced, or are otherwise not readily available. A handy, easily portable caddy capable of holding a variety of necessary layout tools, as well as the chalk line itself, would be of great benefit to the layout field worker. Such a device is not currently available.

SUMMARY OF THE INVENTION

It is thus the object of the present invention to provide a tool layout caddy which overcomes the limitations and disadvantages of similar layout type devices.

It is an object of the present invention to provide a tool layout caddy which is easily portable and capable of storing a variety of necessary tools for layout operations.

It is another object of the present invention to provide a tool layout caddy which is a self-contained device, having the versatility to store necessary layout tools as well as to house a chalk line and chalk line mechanisms to carry out efficient layout operations.

It is a further object of the present invention to provide a tool layout caddy which is relatively lightweight for portability, yet substantial and heavy enough to provide a stable base to maintain one end of a chalk line in fixed position while the other end of the line is extended to the desired location.

It is another object of the present invention to provide a tool layout caddy, which comprises a chalk reservoir through which the caddy's chalk line is constantly resupplied.

It is still another object of the present invention to provide a tool layout caddy whose chalk line, at all times, is readily accessible for ease of use.

These and other objectives are accomplished by the present invention, a tool layout caddy having an upstanding vertical post with a handle at one end and a base member at the other end. A receptacle for the placement and storage of tools, chalk, and other necessary items for the layout operation is secured to the vertical post. A sheath member is provided for the placement and storage of a measuring square. The base member of the caddy houses the chalk line, a chalk line reservoir for replenishing the chalk line, and a chalk line retracting mechanism. A stop marker ensures that the end section of the chalk line always remains external to the base member and, during use, a hook at the end of the chalk line may be secured to the receptacle for ease of access during layout operations.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
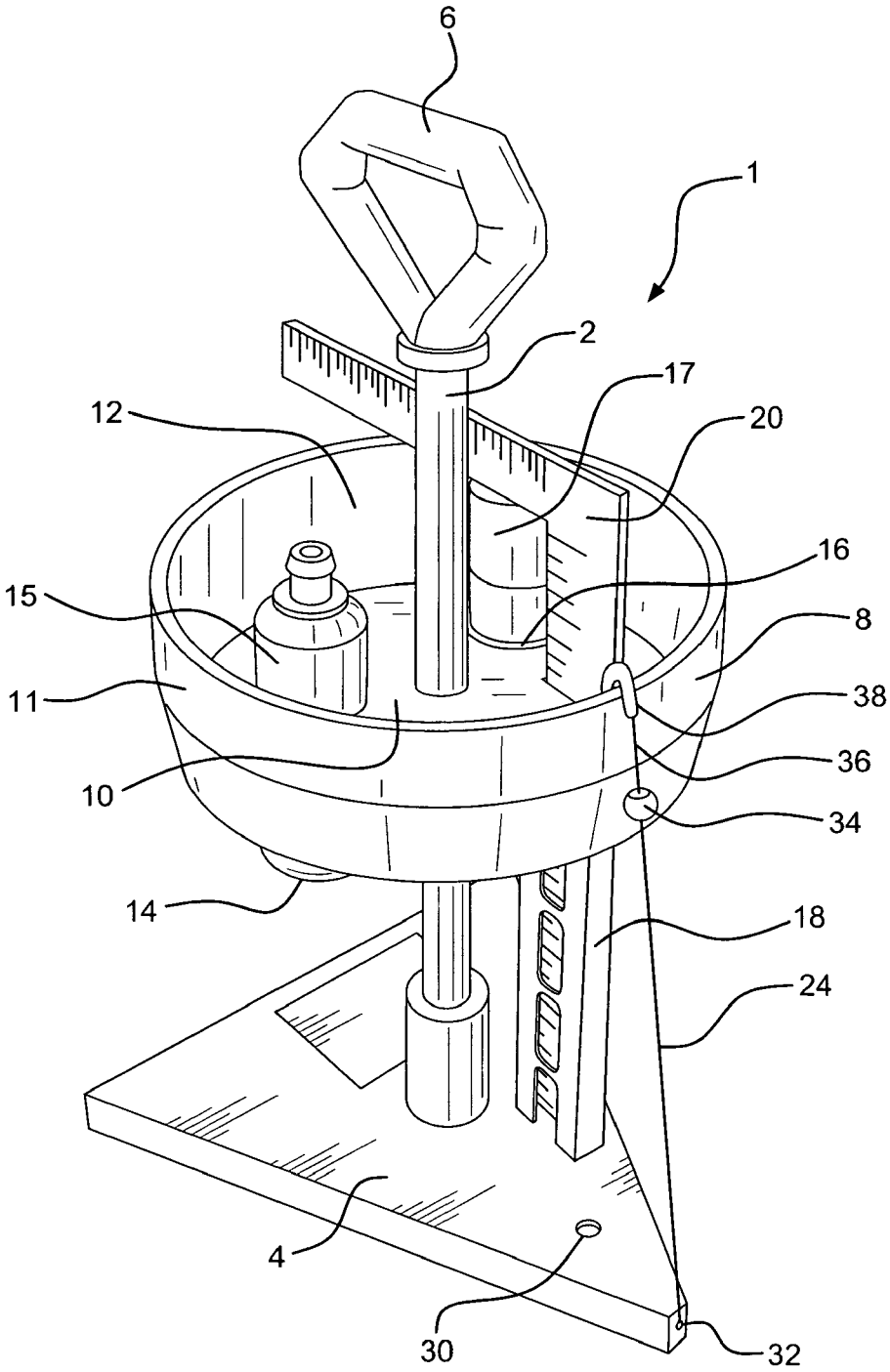
FIG. 1 is an isometric view of the tool caddy of the present invention.
Figure 2:
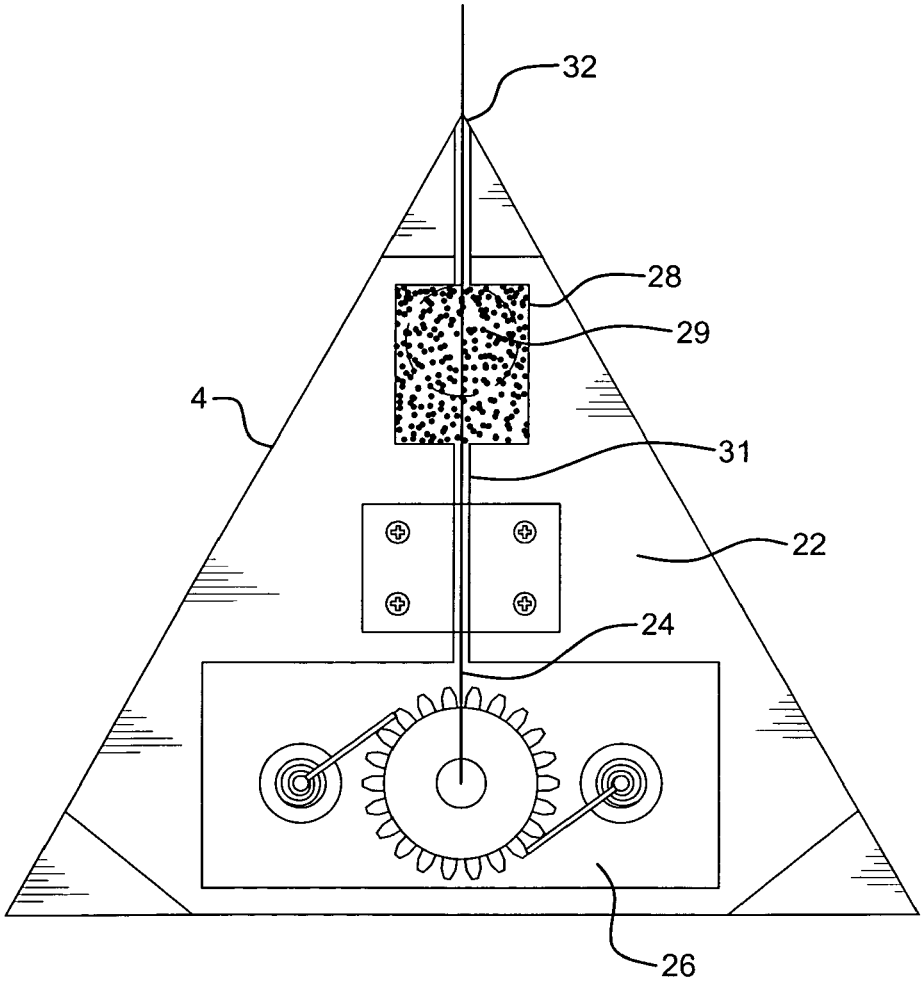
FIG. 2 is a top view of the internal space of the base member of the tool caddy of the present invention, showing the components within that internal space.

Tool caddy 1 of the present invention comprises vertical post 2 connected at its bottom end to base member 4 and at its upper end to handle 6. Post 2 runs through storage receptacle 8, which is secured to the post between its bottom and upper ends.

Receptacle 8 is configured as a curvilinear shaped container with bottom floor 10, side walls 11, and open top 12. Items such as small tools and equipment can be placed on floor 10 within receptacle 8. Small, open cylindrical containers 14 and 16 extend down from floor 10 of receptacle 8 and are configured to hold and store bottle type enclosures 15 and 17 containing various items, ranging from chalk powder to water. Sheath member 18 extends between floor 10 of receptacle 8 and base member 4, and is provided to allow storage of measuring square 20.

Base member 4 comprises an enclosured housing having internal space 22. Located within space 22 is stored chalk line 24 and chalk line retracting and stop retention mechanism 26. It is contemplated that line retracting mechanism 26 can be a device well known to allow line retraction, stop line retention, and line return—such as is commonly used in tape measurers or like devices. The herein invention should not be considered restricted by the type of line retracting mechanism employed within base member 4.

Also within space 22 of base member 4 is chalk reservoir 28 which serves as a chalk storage container. Reservoir 28 is filled with chalk 29 through port 30 located through the top surface of base member 4.

Chalk line 24 runs through channel 31, extending from line retracting mechanism 26, through chalk reservoir 28, to opening 32 located at the end of base member 4. Stop ball-type marker 34 is permanently attached adjacent to end section 36 of chalk line 24. End section 36 of chalk line 24 extends through stop marker 34, which is sized to be larger than opening 32 in order to, at all times, maintain the end section outside base member 4. Hook 38 or equivalent attachment device is secured to the bitter end of end section 36.

In use, tool caddy 1 is lifted by its handle 6 and positioned at the appropriate location in the field for chalk line layout. By pulling stop marker 34, chalk line 24 is unwound from line retracting mechanism 26. As stop marker 34 is pulled, chalk line 24 travels channel 31, through chalk reservoir 28, accumulating chalk 29, and is ultimately withdrawn from base member 4. Chalk line 24 is then stretched out to its required length and snapped to mark layout lines. During this operation, if chalk line 24 is not immediately being used, it can be temporarily secured to the edge of storage receptacle 8, via hook 38. This provides the user with easy access to the chalk line when it is needed again; and obviates the problem of the chalk line fully retreating into base member 4 and the user having to bend over and again withdrawing it from the base member. Attaching chalk line 24 to receptacle 8 guarantees the user quick and convenient accessibility to the chalk line at all times.

Of course tool caddy provides further assistance to the user in that receptacle 8 is configured to hold necessary tools, water, and refreshments and provides for the ready availability of measuring square 20 stored within sheath member 18.

When layout operations are completed, stop marker 34 is simply given a slight tug. This will cause chalk line 24 to be pulled into base member 4 by and rewound onto retracting mechanism 26. Stop marker 34 prevents chalk line from being totally withdrawn into base member 4. Stop marker 34, also remaining outside base member 4, can be used to pull chalk line 24 out of the base member when needed again.

While not to be considered so restricted, it is contemplated that tool caddy 1 will be approximately 36 inches in height, 14 inches in length, and 14 inches in width, with a polystyrene handle 6, plastic storage receptacle 8, plastic containers 14 and 16, plastic sheath member 18, aluminum alloy tubing for vertical post 2, and aluminum alloy for base member 4. It is anticipated that tool caddy 1, with tools positioned therein, will weight approximately ten pounds.

It is significant that the overall weight of tool caddy 1, especially with tools and the measuring square, is sufficient such that once placed in position, the caddy will remain stationary, even when chalk line 24 is being pulled from then and let go into base member 4. Thus there is no need for an extra worker to hold one end of chalk line 24 during construction layout operations.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A tool layout caddy comprising:

an upstanding vertical post extending through substantially the center of the caddy, said post having top and bottom ends;

a handle extending up from the top end of the post;

receptacle means for the storage of tools and equipment, the post extending through the receptacle means, the receptacle means being located on the post between and in spaced relation to both the top and bottom ends of the post;

a base member connected to the bottom end of the post at a location inboard of the sides of the base member, said base member housing a chalk reservoir containing chalk and a chalk line with an end section located outside the housing, the base member further comprising means to retractably store the chalk line within said base member;

stop means located adjacent to the end section of the chalk line for at all times maintaining the end section of the chalk line external to the base member and for permitting pulling the chalk line out of the base member; and attachment means at the end section of the chalk line for securing an external section of the chalk line to the receptacle means.

2. The tool layout caddy as in claim 1 wherein the receptacle means has a bottom floor and wherein the caddy further comprises a sheath member extending from the floor of the receptacle means to the base member for the storage of a measuring square.

3. The tool layout caddy as in claim 1 wherein the receptacle means comprises a curvilinear shaped member with a bottom floor and an open top.

4. The tool layout caddy as in claim 1 wherein the receptacle means comprises a bottom floor and container means extending down from the bottom floor for the placement of bottle type enclosures or miscellaneous items.

5. The tool layout caddy as in claim 1 wherein the retractable storage means comprises a line retracting and stop retention mechanism.

6. The tool layout caddy as in claim 1 wherein the base member further comprises an opening through which the chalk line extends.

7. The tool layout caddy as in claim 1 wherein the stop means comprises a ball-type marker.

8. The tool layout caddy as in claim 1 wherein the attachment means comprises a hook.

* * * * *